US011001973B2

(12) United States Patent
Anderson et al.

(10) Patent No.: US 11,001,973 B2
(45) Date of Patent: May 11, 2021

(54) APPARATUS AND COMPONENTS FOR TURNOUT/CROSSOVER SECTION FOR RAILWAY TRACK

(71) Applicant: Non Intrusive Crossover System Limited, Glasgow (GB)

(72) Inventors: Roy Anderson, Glasgow (GB); Donald McCallum, Glasgow (GB); Henry Maxwell, Glasgow (GB)

(73) Assignee: Non Intrusive Crossover System Limited, Glasgow (GB)

( * ) Notice: Subject to any disclaimer, the term of this patent is extended or adjusted under 35 U.S.C. 154(b) by 256 days.

(21) Appl. No.: 15/746,586

(22) PCT Filed: Jul. 8, 2016

(86) PCT No.: PCT/GB2016/052066

§ 371 (c)(1),
(2) Date: Jan. 22, 2018

(87) PCT Pub. No.: WO2017/013395

PCT Pub. Date: Jan. 26, 2017

(65) Prior Publication Data

US 2019/0003129 A1 Jan. 3, 2019

(30) Foreign Application Priority Data

Jul. 23, 2015 (EP) ..... 1512999

(51) Int. Cl.
*E01B 7/30* (2006.01)
*E01B 23/06* (2006.01)
*E01B 7/22* (2006.01)

(52) U.S. Cl.
CPC ..... *E01B 7/30* (2013.01); *E01B 7/22* (2013.01); *E01B 23/06* (2013.01); *E01B 2201/00* (2013.01)

(58) Field of Classification Search
CPC ..... E01B 7/00; E01B 7/22; E01B 7/30; E01B 2/00; E01B 3/24; E01B 3/40; E01B 11/02;

(Continued)

(56) References Cited

U.S. PATENT DOCUMENTS 413,186 A * 10/1889 Johnson ..... E01B 23/06 238/12
824,271 A * 6/1906 Aldrich et al. ..... E01B 23/06 238/12

(Continued)

FOREIGN PATENT DOCUMENTS

CN 200960938 Y 10/2007
CN 102897190 A 1/2013

(Continued)

OTHER PUBLICATIONS

International Search Report and Written Opinion issued in corresponding PCT/GB2016/052066 dated May 22, 2017.

*Primary Examiner* — Jason C Smith
(74) *Attorney, Agent, or Firm* — Andrus Intellectual Property Law, LLP

(57) ABSTRACT

A gauge spacing apparatus for positioning pot sleepers with respect to existing sleepers of a railway track has a pair of turnout rails, which are separated from one another by a desired gauge distance. The gauge spacing apparatus includes a first guide member aligned with and secured with respect to a portion of the existing rail; and a second guide member angled with respect to the first guide member at a turnout angle. The second guide member is aligned with a portion of a turnout rail to allow the turnout rail to be provided with supporting pot sleepers, such that the desired gauge between the turnout rails is maintained. Also provided are a rectangular gauge spacing apparatus, a shear plate arrangement for providing supported engagement between first and second sections of rail, and a support framework for supporting a planar supporting member spanning over an existing rail.

13 Claims, 18 Drawing Sheets

(58) Field of Classification Search
CPC ..... E01B 11/10; E01B 11/26; E01B 11/30; E01B 11/32; E01B 11/42; E01B 23/00; E01B 23/06
See application file for complete search history.

(56) References Cited

U.S. PATENT DOCUMENTS

| | | | | | |
|---|---|---|---|---|---|
| 1,126,524 | A * | 1/1915 | Liebmann | E01B 11/10 | 238/172 |
| 1,887,063 | A * | 11/1932 | Nast | E01B 11/32 | 238/228 |
| 2,219,328 | A * | 10/1940 | Cullen | E01B 7/30 | 246/380 |
| 3,096,057 | A * | 7/1963 | Devaney, Jr. | E01B 7/30 | 246/465 |
| 7,434,768 | B2 * | 10/2008 | Humphrey | E01B 23/00 | 246/374 |
| 2014/0263864 | A1 * | 9/2014 | Gehringer | E01B 7/00 | 246/415 R |
| 2019/0003129 | A1 * | 1/2019 | Anderson | E01B 7/22 | |

FOREIGN PATENT DOCUMENTS

| | | | |
|---|---|---|---|
| DE | 2649830 | A1 | 9/1977 |
| WO | 2005083179 | A2 | 9/2005 |
| WO | 2014071690 | A1 | 5/2014 |

* cited by examiner

APPARATUS AND COMPONENTS FOR TURNOUT/CROSSOVER SECTION FOR RAILWAY TRACK

CROSS-REFERENCE TO RELATED APPLICATIONS

This application is the U.S. national stage application of International Application PCT/GB2016/052066, filed Jul. 8, 2016, which international application was published on Jan. 26, 2017, as International Publication WO2017/013395 in the English language. The international application is incorporated herein by reference, in its entirety. The international application claims priority to GB Patent Application No. 1512999.2, filed Jul. 23, 2015, which is incorporated herein by reference, in its entirety.

The present invention relates to improvements in a turnout or crossover section of railway track and particularly, but not exclusively, relates to improvements of a temporary non-intrusive turnout or crossover section of a railway track.

Railway track requires to be maintained at regular intervals and, in order to achieve this, the section of track that is being maintained must be first cleared of trains. The track is normally closed to traffic, often during no train periods, but also outside of such periods thus causing train cancellations or trains diversion to other routes for short or longer terms (blockades). In some instances, the trains are transferred from the track having the maintenance performed on it onto an adjacent track for a limited period (i.e. a few hours) and then back onto the original track. The trains are transferred onto the adjacent track by means of a crossover section of track and returned by means of a second crossover. This is known in the art as "Single Line Working" (SLW). Conventionally, each of the crossover sections are intrusive, in that the section of track at which the crossover section is inserted must be cut; this involves cutting the existing rails of each railway track twice and installing the temporary crossover and also installing the switchgear and signalling interface. However, such intrusive crossover sections are relatively expensive and require a relatively long time to plan and install. The planning stage alone may take in the region of 2 years.

One way of addressing this problem is to utilise a non-intrusive crossover as described in International Patent Publication No. WO 2005/083179 (WO '179) the contents of which are incorporated herein by reference thereto. WO '179 describes a method of non-intrusively crossing a train over from one track to another; however, this arrangement has its own problems regarding installation, connection, support and legislation.

In the context of this application, it should be noted that a non-intrusive crossover is one that does not pass through the rail to be crossed but instead crosses over the rail to be crossed.

According to a first aspect of the present invention there is provided gauge spacing apparatus for positioning pot sleepers with respect to existing sleepers of a railway track provided with a pair of turnout rails which are separated from one another by a desired gauge distance, the gauge spacing apparatus comprising: a first guide member adapted to be substantially aligned with and secured with respect to a portion of existing rail; and a second guide member which is angled with respect to the first guide member at or toward a turnout angle such that the second guide member is substantially aligned with a portion of a turnout rail and to allow said portion of turnout rail to be provided with a plurality of pot sleepers which support the turnout rail such that said desired gauge between the turnout rails is maintained and wherein at least one of the first and second guide members is provided with adjustable sleeper engagement brackets which are adapted to selectively translate along at least a portion of the first or second guide members in order to allow the sleeper engagement brackets of the first guide member to be secured relative to the existing sleepers and the sleeper engagement brackets of the second guide member to be secured to pot sleepers which are interstitially positioned between existing sleepers of an adjacent section of railway track.

According to a second aspect of the present invention there is provided a method of supporting and maintaining gauge spacing in a pair of turnout rails, with apparatus according to the first aspect, the method comprising: positioning the first guide member with respect to a portion of existing rail; positioning the second guide member with respect to turnout rail; positioning a plurality of pot sleepers interstitially between existing rails of a second railway track and beneath at least one of the turnout rails; attaching a plurality of adjustable sleeper engagement brackets to the first guide member, adjusting these into position adjacent respective existing sleepers of the existing railway track, and securing these in position with respect to the existing sleepers and to the first guide member; and attaching a plurality of adjustable sleeper engagement brackets to the second guide member, adjusting these into position over the respective pot sleepers and securing these in position to the pot sleepers and to the second guide member such that said desired gauge between the turnout rails is maintained.

According to a third aspect of the present invention there is provided gauge spacing apparatus for positioning pot sleepers for turnout rails having a desired gauge distance and which are provided between a pair of railway tracks which are separated from one another by a rail spacing distance, the gauge spacing apparatus comprising: a first guide member adapted to be substantially aligned with and secured to pot sleepers of a first turnout rail; and a second guide member adapted to be substantially aligned with and secured to pot sleepers of a second adjacent turnout rail and at least a spacing member between the first and second guide members such that said desired gauge between the turnout rails is maintained and wherein at least one of the first and second guide members is provided with adjustable sleeper engagement brackets which are adapted to selectively translate along at least a portion of the first or second guide members in order to allow the sleeper engagement brackets of the first guide member to be secured to pot sleepers which are interstitially positioned between existing sleepers of the first railway track and for the sleeper engagement brackets of the second guide member to be secured to pot sleepers which are interstitially positioned between existing sleepers of the second railway track.

According to a fourth aspect of the present invention there is provided a method of supporting and maintaining gauge spacing in a pair of turnout rails provided with apparatus of the first aspect, the method comprising: positioning the first guide member with respect to a first rail of the turnout rails; positioning the second guide member with respect to a second rail of the turnout rails; positioning a plurality of pot sleepers interstitially between existing rails of the first section of railway track and beneath the first turnout rail; positioning a plurality of pot sleepers interstitially between existing rails of the second section of railway track and beneath the second turnout rail; attaching a plurality of adjustable sleeper engagement brackets to the first guide member, adjusting these into position over respective pot sleepers thereunder and securing these in position to said pot sleepers and to the first guide member; and attaching a plurality of adjustable sleeper engagement brackets to the second guide member, adjusting these into position over the respective pot sleepers thereunder and securing these in position to said pot sleepers and to the second guide member such that said desired gauge between the turnout rails is maintained.

According to a fifth aspect of the present invention there is provided a shear plate arrangement for providing supported engagement between a first section of rail having a support arrangement for a non-intrusive crossover arrangement and a second section of rail, the shear plate arrangement comprising: a substantially rectangular form upper engagement plate having a lower substantially horizontal abutment surface formed by a lower edge of the plate; a second rail attachment arrangement adapted to securely retain the upper engagement plate with a cut end of the second section of rail; a substantially rectangular form lower engagement plate having an upper substantially horizontal abutment surface formed by an upper edge of the plate and being adapted to selectively abut against the lower abutment surface of the upper engagement plate in order to provide supported engagement to the upper engagement plate; and a first rail attachment arrangement adapted to securely retain the lower engagement plate with a supporting arrangement of the first section of rail such that the loading of a train's wheel is supported by said abutment between the upper and lower engagement surfaces as it pass from the first to the second section of rail.

According to a sixth aspect of the present invention there is provided a method of attaching a first section of rail having a support arrangement for a non-intrusive crossover arrangement, to a second section of rail, the method comprising: attaching a shear plate arrangement according to the fifth aspect to the support arrangement of the first section of rail and to the second section of rail; positioning the cut end of the second section of rail adjacent the support arrangement of the first section of rail in order to rest the lower surface of the upper shear plate on the upper surface of the lower shear plate in order to provided supported engagement between the first and second sections of rail.

According to a seventh aspect of the present invention there is provided a method which enables Single Line Working on a second railway track to clear a first railway track for maintenance or other purposes, the method comprising the steps of: providing a first non-intrusive crossover on either side of at least a portion of the first railway track; providing a second non-intrusive crossover on either side of at least a portion of a respective rail of the first railway track at a location which is spaced apart from the first non-intrusive crossover in the direction of the longitudinal axis of the pair of railway tracks; each non-intrusive crossover having a planar upper supporting member spanning over a respective pair of said lower supporting members, an upper surface of the planar upper supporting member being attached to at least a portion of a lower surface of the respective rail of the second railway track; passing the train along the first non-intrusive crossover; passing the train along the portion of the second railway track between the first and second non-intrusive crossover; passing the train along the second non-intrusive crossover, such that the train is returned to a location on the first railway track which is spaced apart in the longitudinal direction from the first non-intrusive crossover; and wherein the method further comprises the step of removing a respective upper supporting member and attached rail portion of the first and second non-intrusive crossover such that at least the lower supporting members remain on either side of the first railway track and allowing a train to pass along the first railway track without crossing from the first to the second railway track and wherein at least a portion of said lower supporting members are connected to the or each non-intrusive crossover by a shear plate arrangement according to the fifth aspect.

According to an eighth aspect of the present invention there is provided a support framework for supporting, by way of an existing rail and rail sleeper, a planar supporting member spanning over said existing rail, the support framework comprising:

an outer side support box adapted to rest on a portion of existing rail sleeper and engage with a longitudinal outer side of said existing rail, and an inner side support box adapted to rest on a portion of the existing rail sleeper and engage with a longitudinal inner side of said existing rail;

a clamping arrangement adapted to clamp the existing rail longitudinally between the outer and inner side support boxes in order to thereby secure said boxes to said existing rail to thereby locate said planar supporting member when placed upon the support boxes and over the existing rail.

Embodiments of the present invention will now be described, by way of example only, with reference to the accompanying drawings, in which.

In the following description the term "timber" means any wooden or non-wooden material capable of being utilised as a substitute for wooden material and includes for example mixed recycled plastic and other materials.

Figure 1:
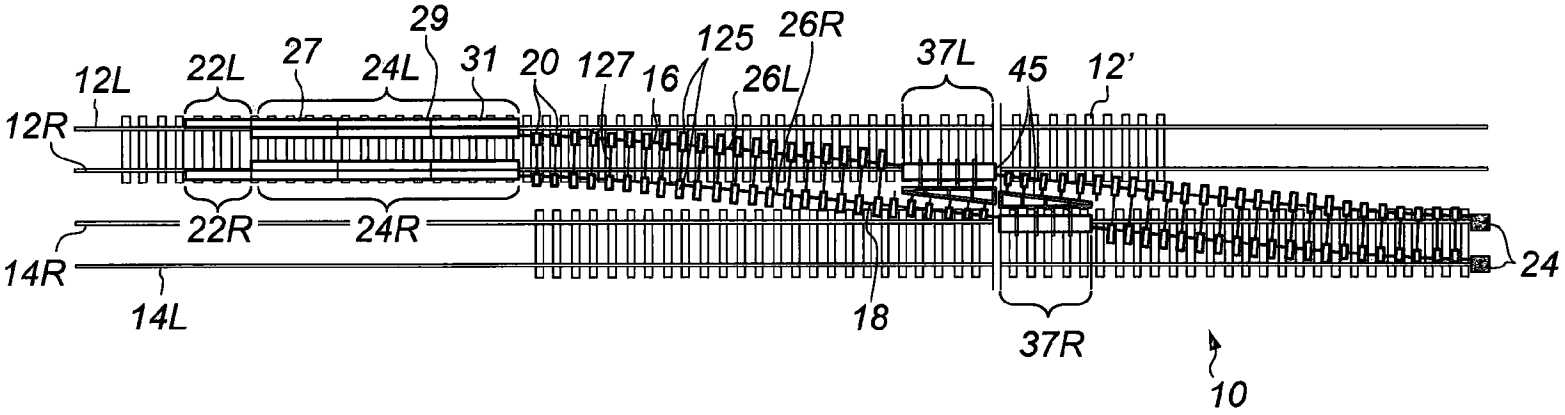
FIG. 1 is a plan view of a temporary non-intrusive crossover provided with the various improvements of the present invention.

FIG. 1 shows a non-intrusive crossover arrangement generally designated 10. It will be appreciated by the reader that two spaced apart non-intrusive turnouts utilised on a section of track combine to provide the non-intrusive crossover 10.

As shown in FIG. 1, the temporary non-intrusive crossover 10 links a south bound rail track 12 and a north bound rail track 14, such that a train travelling on the south bound rail track 12 can be transferred onto the north bound rail track 14 for a short section in order to bypass a section of track 12' requiring maintenance or repair before it is then transferred back onto the south bound rail track 12 by a second non-intrusive crossover (not shown) located further along the track.

The temporary non-intrusive turnout 10 comprises a pair of adjacent turnout tracks 16, 18 and a plurality of temporary pot sleepers 20 positioned thereunder. For ease of reference, and with reference to the track 12 being a southbound track in the present example, the turnout track designated 16 will subsequently be referred to as the left hand turnout track and the turnout track designated 18 will be subsequently referred to as the right hand turnout track.

Figure 2:
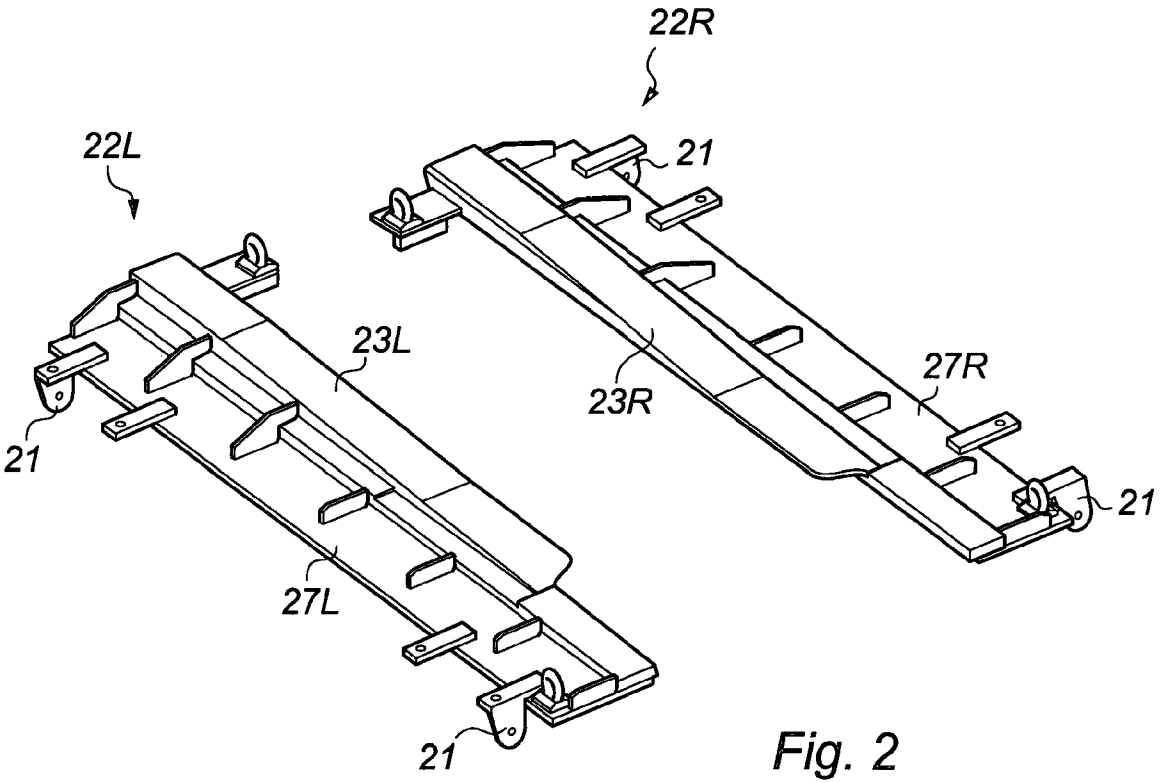
FIG. 2 is a perspective illustration of upper left and right ramp rail sections of the crossover illustrated in FIG. 1.

The left hand turnout track 16 first comprises, from the left hand end of FIG. 1, a ramp rail section 22L. As best illustrated in FIG. 2, the uppermost portion of the ramp rail 22L is wedge shaped, with the uppermost surface 23 gradually tapering linearly from its lowest end which has a height of 0 mm up to its highest end which has a height of approximately 50 mm. The ramp rail 22L (and its corresponding right hand ramp rail 22R) are coupled to the south bound existing tracks 12L, 12R by means of planar supports 27L, 27R which themselves are supported by support boxes provided thereunder (described subsequently).

Following on from the ramp rail 22L from left to right, the left hand turnout track 16 next comprises a switch rail arrangement 24L the left most end of which is arranged to join the right most end of the left ramp rails 22 as will be described subsequently. A corresponding switch rail arrangement 24R is also provided on the right hand turnout rail 18.

Figure 3:
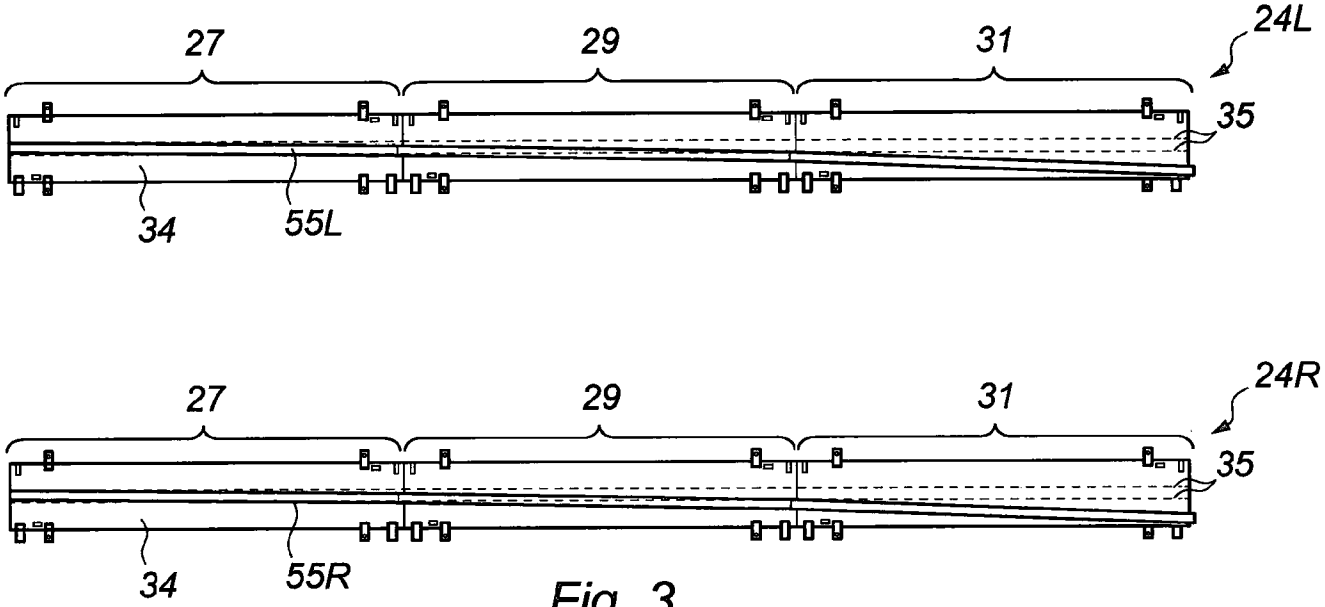
FIG. 3 is a plan view of left and right adjacent switch rail sections of the crossover illustrated in FIG. 1.

As best illustrated in FIG. 3, the switch rails 24L, 24R each comprise three progressive sections 27, 29, 31 having a respective head portion SSL, SSR which are each progressively curved along their length to an increasing degree, toward the north bound rail track 14 and thus away from the south bound rail track 12. The head portions 55L, 55R are of a height which corresponds with the height of the higher end of the ramp rail 22L, 22R to ensure a smooth transition of any wheel passing from the ramp rail to the switch rail.

Figure 4C:
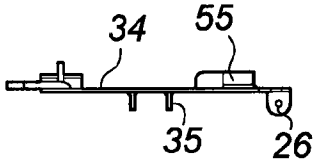
FIG. 4C is a cross-sectional end view of the third switch rail section 31 shown in FIG. 3.
Figure 4B:
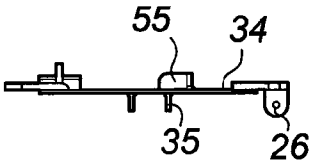
FIG. 4B is a cross-sectional end view of the second switch rail section 29 shown in FIG. 3.
Figure 4A:
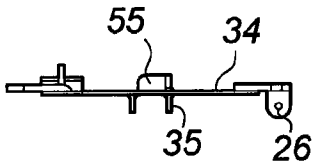
FIG. 4A is a cross-sectional end view of the first switch rail section 27 shown in FIG. 3.

As shown in FIGS. 4A to 4C, each switch rail arrangement 27, 29, 31 comprises a planar support plate 34 which is supported by a support box section similar to that found on the ramp rail arrangements 22. Locating flanges 35 project downwardly from the support plate 34 and run along the length of the switch rail arrangements 27, 29, 31 such that they rest over the rail head of the existing head when in use.

Following on from the switch rail arrangements, from left to right, the left and right hand turnout tracks 16, 18 next comprise a gut rail 26L, 26R. The gut rails 26L, 26R continue to bend at approximately the same radius as the bend radius of the switch rails 24L, 24R and are supported from underneath by the temporary pot sleepers 20.

Following on from the gut rails 26L and 26R, the next components of the non-intrusive crossover are crossing rail arrangements (on the left hand turnout rail 16 this will facilitate crossing of the right hand rail 12R of the existing southbound track and, on the right hand turnout rail 18, this will facilitate crossing of the right hand rail 14R of the existing north bound track).

Figure 5:
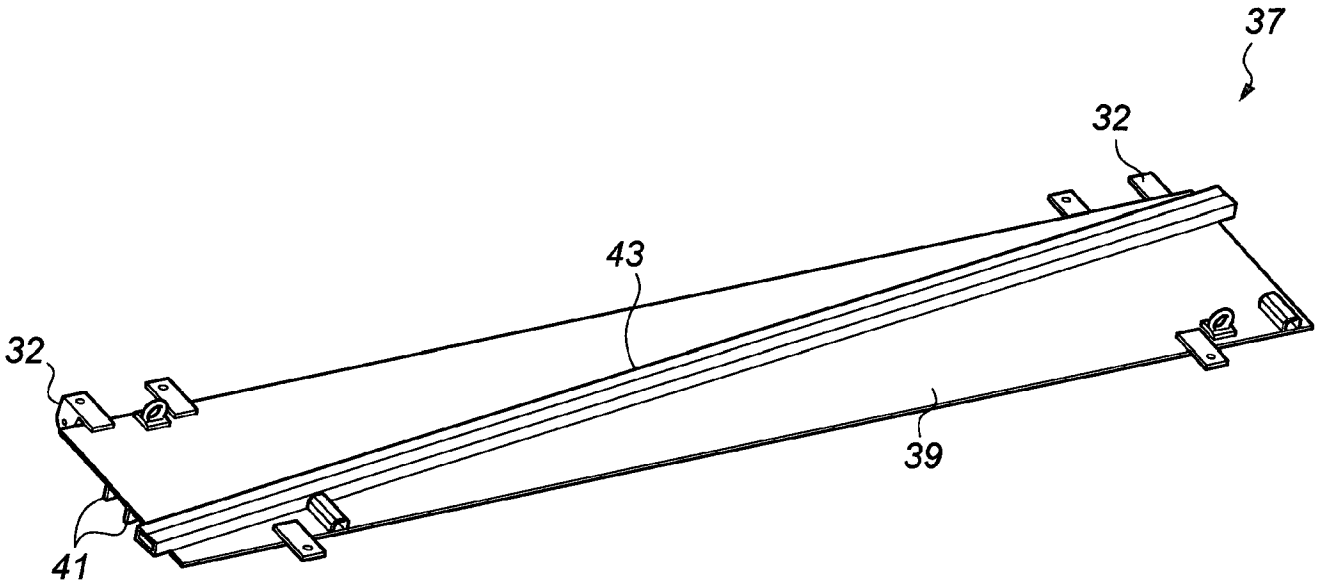
FIG. 5 is a perspective illustration of an upper crossover rail section of the crossover illustrated in FIG. 1.

As best illustrated in FIG. 5, each crossing arrangement 37 comprises a planar support plate 39 which is supported by a support box section similar to those found underneath the ramp rail arrangements and switch rail arrangements previously described. Locating flanges 41 run along the length of the crossing arrangement 37 such that they rest over the rail head of the existing rail when in use. A crossing rail head 43 spans diagonally across the top of the planar support plate 39 at an angle which coincides with the adjacent gut rail in order to allow running of a train wheel thereover.

Figure 6:
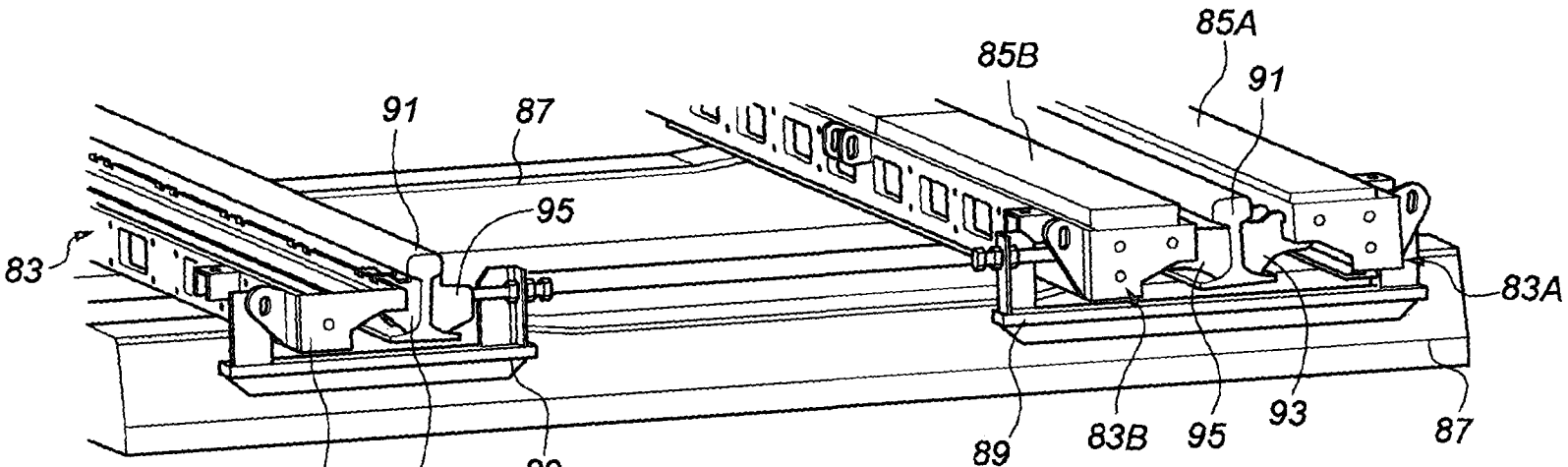
FIG. 6 is a perspective illustration of left and right support boxes of the crossover section illustrated in FIG. 1.
Figure 7B:
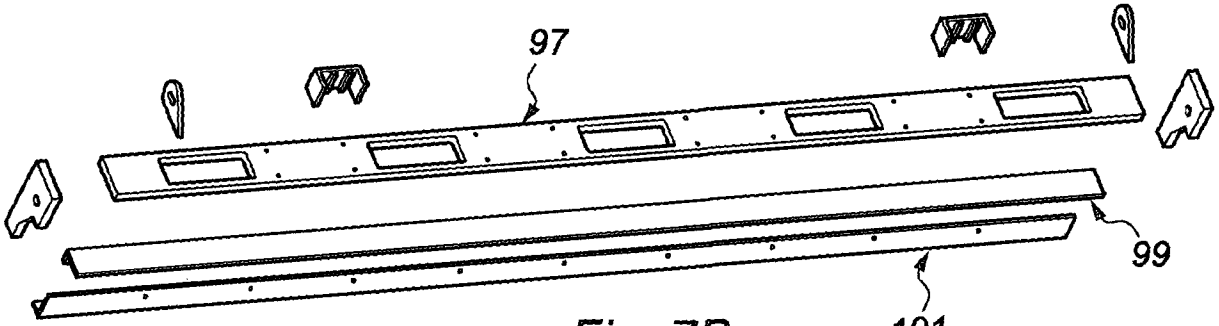
FIG. 7B is an exploded view of the support arrangement of FIG. 7A.
Figure 7A:
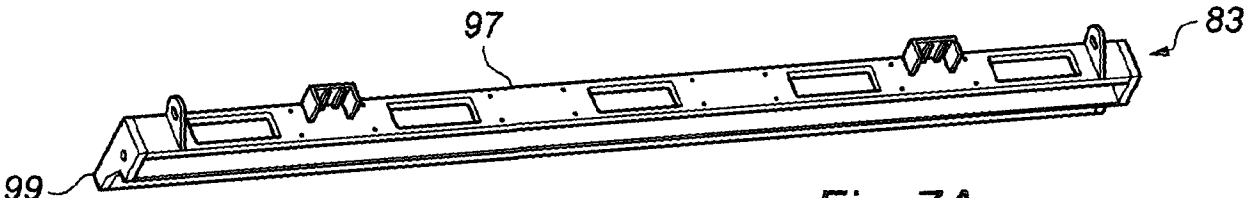
FIG. 7A is an underside perspective view of a support arrangement which is utilised with the crossover arrangements illustrated in FIG. 1.
Figure 7D:
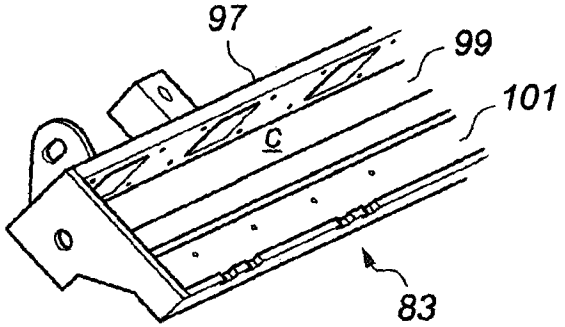
FIG. 7D is a lower end view of the support arrangement of FIG. 7A.
Figure 7C:
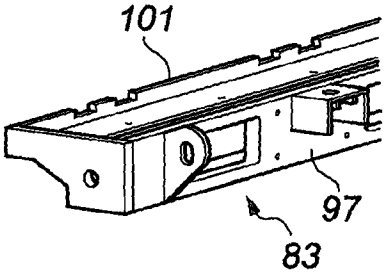
FIG. 7C is an upper end view of the support arrangement of FIG. 7A.

As mentioned above certain components (such as the ramp arrangements 22, switching arrangements 24 and crossing arrangements 37) are supported by one or more support boxes. The arrangements illustrated in FIG. 6 provide a support framework which allows a planar supporting member (such as that shown in FIG. 5) to rest upon the existing sleepers 97 thereunder and to be laterally and longitudinally secured to the existing rail 91. Illustrated utilisation of the support boxes 83 are provided with reference to FIGS. 6 to 8 where each outer (field side) support box frame 83A and inner (gauge side) support box frame 83B surrounds associated intermediate longitudinal support members in the form of timber bridging members 85A, 85B which are laid perpendicularly across existing sleepers 87. Each timber member 85A, 85B may either comprise a single or dual timber member shaped to fit neatly within the profile of its associated support box frame. Bearing pads or other arrangements may be provided at the junction 99 in order to provide secure, supported engagement between the support boxes and the existing sleepers thereunder. Lateral support clamps 89 retain the outer and inner support boxes 83A, 83B in secure abutment with the sides of the existing rail 91 web by way of field side spacing blocks 93 and gauge side spacing blocks 95.

Rear plate 97, intermediate brace 99, front brace 101 and associated components of the support boxes 83A, 83B are illustrated in greater detail in FIGS. 7A to 7D and together form a longitudinal cavity C along the length of the support boxes 83 which are each dimensioned to receive either single piece or dual piece timber bridging members 85A, 85B therein in order to transfer any supported load to the respective support boxes 83A, 83B and hence to the existing sleepers 99 thereunder on which the support boxes 83A, 83B rest. It can be seen from these illustrations that apertures, holes and gaps are provided in the walls of the boxes 83A, 83B in order to minimise the overall weight of the support boxes whilst maximising their overall structural strength and integrity.

Figure 8B:
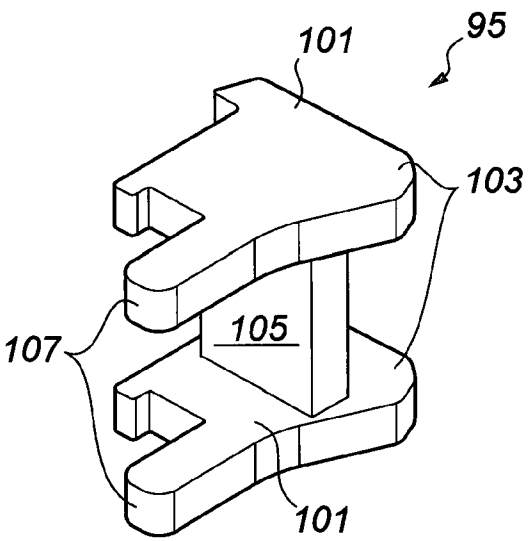
FIGS. 8A and 8B are more detailed illustrations of respective field side and gauge side spacer block arrangements utilised with the support arrangements of FIG. 7A.
Figure 8A:
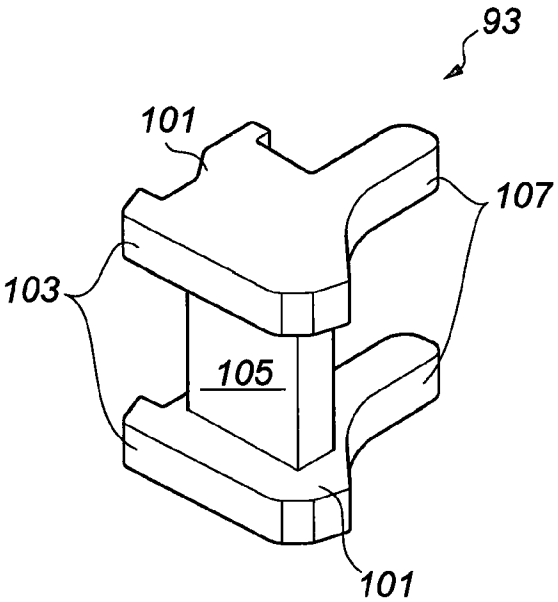
Figure 9A:
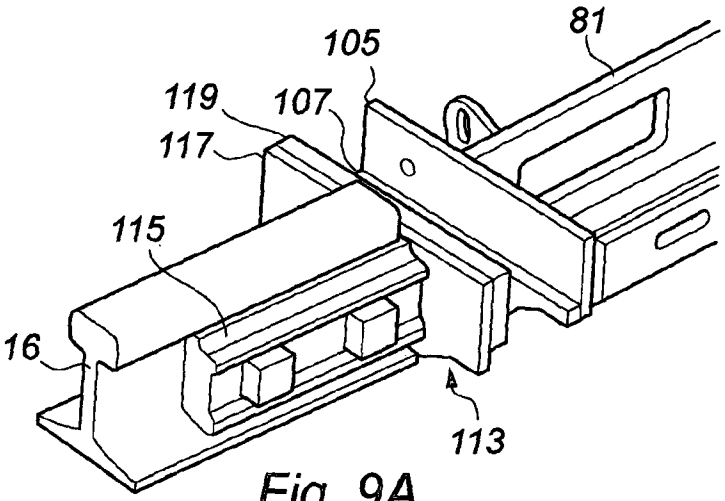
FIGS. 9A to 9D are perspective illustrations of shear plate arrangements according to an aspect of the present invention, where the shear plate arrangements are mounted to selectively join a cut section of turnout rail with a support box.
Figure 9B:
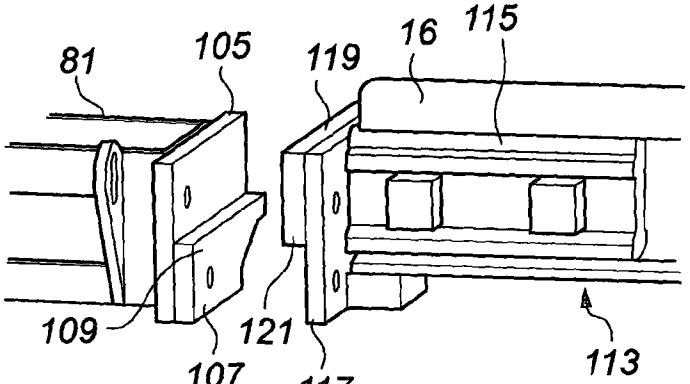
Figure 9C:
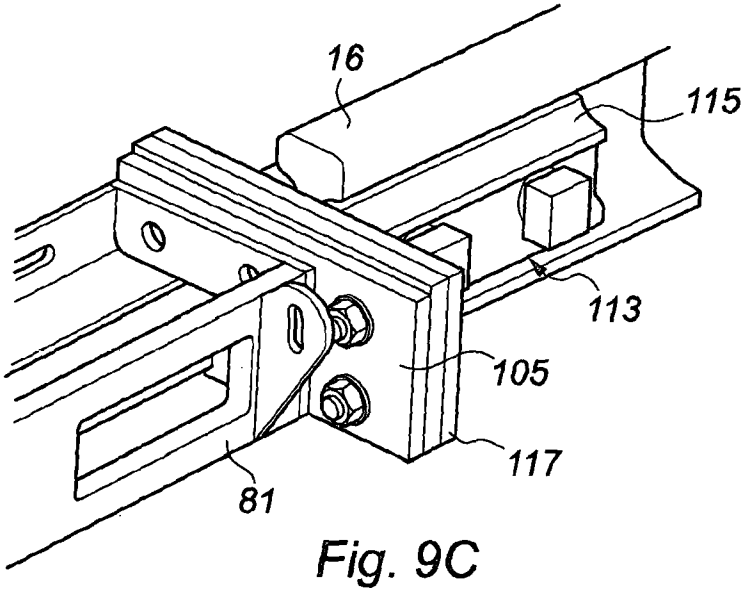
Figure 9D:
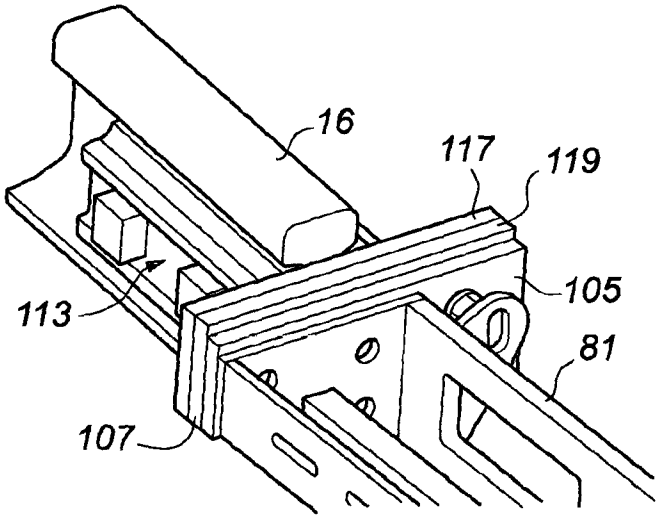

Inner and outer s spacer blocks 93, 95 are also clamped between the existing rail 91 and the side edges of the adjacent support boxes 83A, 83B. As best illustrated in FIGS. 8A and 8B in order to provide a secure and stable attachment to the web of the existing rail 91 the spacer blocks 93, 95 comprise a pair of side plates 101 connected to one another by bracing members 105. The pair of side plates 101 have a pair of substantially flat facing edges 103 for mating into abutment with the substantially flat sides of the existing rail web and a pair of nosed sections 107 for supporting engagement with the underside of the respective support boxes 83A, 83B.

With reference to FIGS. 9A to 9D, the support box 81 of the third switching arrangement 31 (i.e. the right hand end of the switching arrangement 24 as illustrated in FIG. 1) is provided with a facing plate 105 which in turn is provided with a lower shear plate 107 mounted thereto. The lower shear plate 107 has a support ledge 109 provided along its upper surface. A cut end of the turnout rail 16, 18 is provided with a shear plate attachment bracket 113 having a pair of forked prongs 115 for attachment around the web of the rail 16, and a facing plate 117 that corresponds with the facing plate 105 of the support box 81 and which in turn is provided with an upper shear plate 119 mounted thereto. The upper shear plate 119 has a support ledge 121 along its lower surface corresponding to the opposing support ledge of the lower shear plate 109. This arrangement provides a joint between the support boxes 81 of the switching arrangements and the turnout rails 16 as will be described subsequently.

Figure 10:
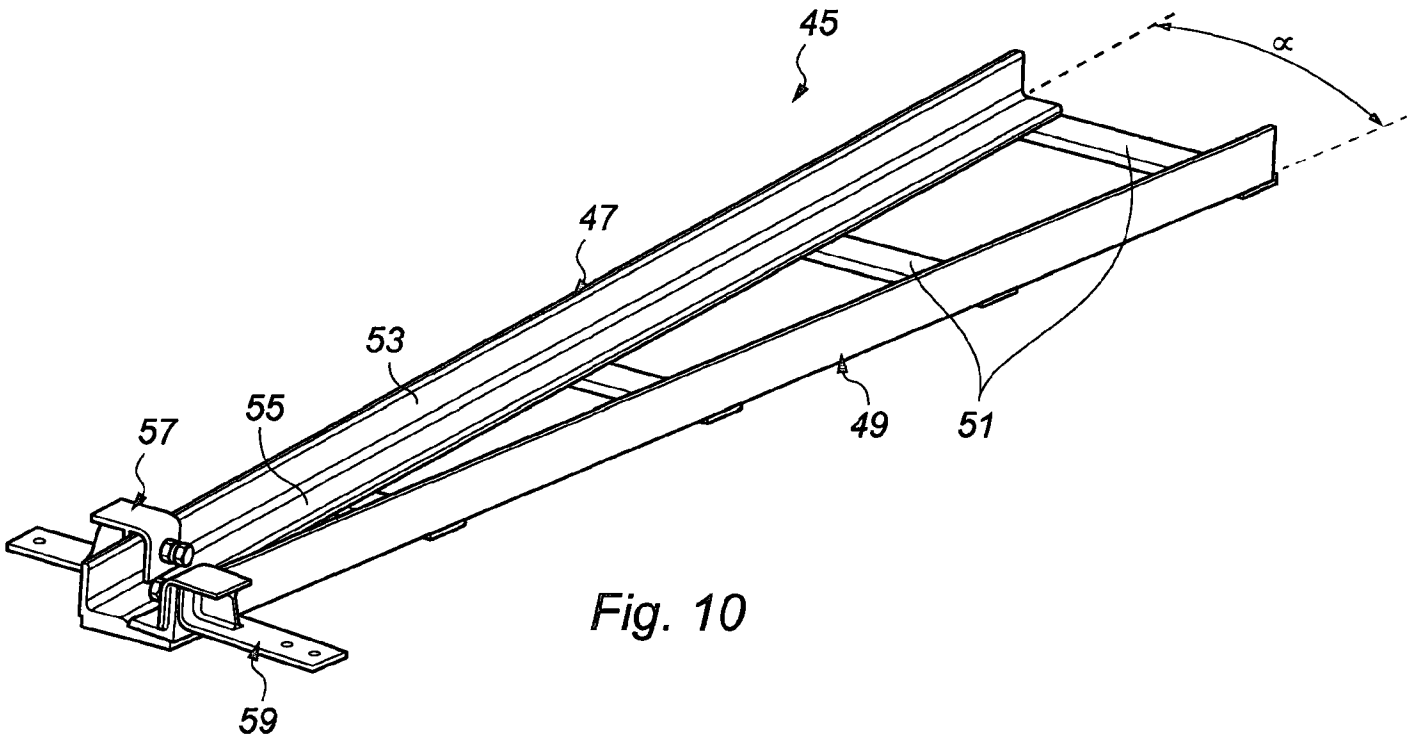
FIG. 10 is a perspective illustration of an A-frame gauge spacing guide according a further aspect of the present invention where the guide is provided with a pair of adjustable sleeper brackets.

A-frame gauge spacing frames 45 are provided adjacent each of the crossing arrangements 37. As best illustrated in FIG. 10 each A-frame 45 comprises a first guide member 47 and a second guide member 49 which is retained at an angle $\alpha$ with respect to the first guide member by cross brace members 51. The angle $\alpha$ substantially coincides with the typical expected angle at which the turnout rails depart from the existing rails of the railway track; however, the ability to account for discrepancies in these two angles is provided by the adjustment brackets described subsequently. Each guide rail member comprises a bar having an L-shaped cross section having an upstanding flange 53 and base flange 55.

Although only two engagement brackets are illustrated in FIG. 10, several (typically three to four) existing rail engagement brackets 57 are provided along the first guide member 47, and several (typically three to four) temporary pot sleeper engagement brackets 59 are provided along the second guide member 49.

Figure 11A:
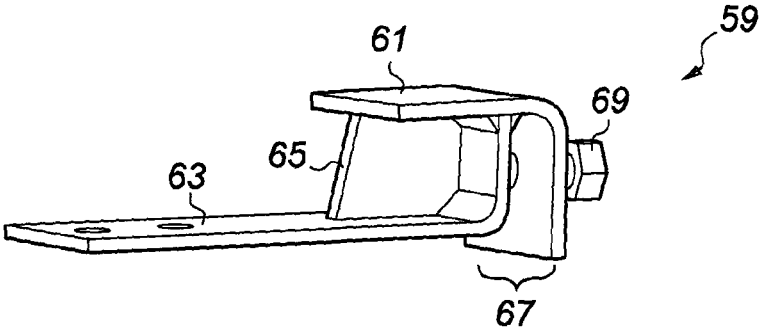
FIG. 11A is a more detailed isolated illustration of a pot sleeper adjustable sleeper engagement bracket.

As best illustrated in FIG. 11A, each temporary pot sleeper engagement bracket 59 comprises an upper flange 61 and a lower flange 63 which are connected to one another by a strengthening web 65. A guide member engagement slot 67 is provided with securing means in the form of a threaded bolt 69 to allow the bracket 59 to be positioned on and secured to the parallel guide member 49.

Figure 11B:
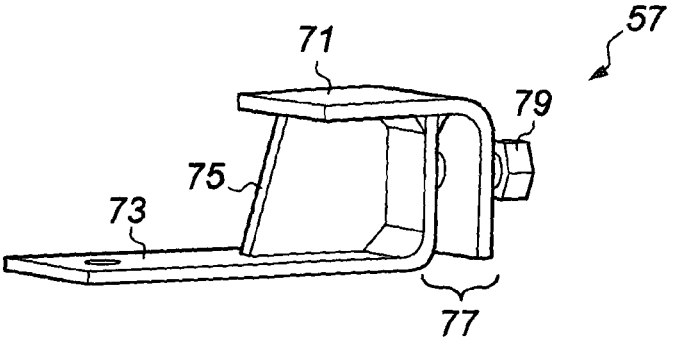
FIG. 11B is a more detailed isolated illustration of an adjustable sleeper engagement bracket for an existing sleeper guide of FIG. 10.

As best illustrated in FIG. 11B, each existing rail engagement bracket 57 comprises an upper flange 71 and a lower flange 73 which are connected to one another by a strengthening web 75. A guide member engagement slot 77 is provided with a securing means in the form of a threaded bolt 79 to allow the bracket 57 to be positioned on and secured to the angled guide member 47.

Figure 12:
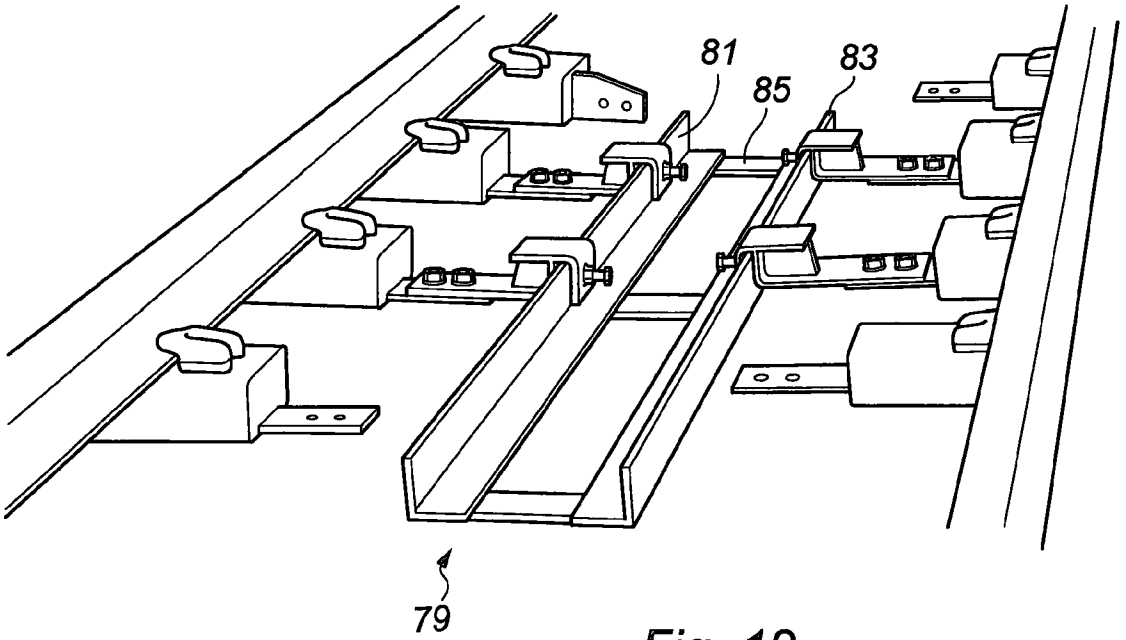
FIG. 12 is a perspective illustration of a rectangular gauge spacing guide in position adjacent turnout rails of the non-intrusive crossover section.

As illustrated in FIG. 12A, a rectangular gauge spacing frame 79 having similar features to the A-frame 45 is also provided. The rectangular frame also has a first guide member 81 and a second guide member 83; however rather than being angled relative to one another these two guide members are instead retained substantially parallel to one another by bracing members 85.

Figure 13:
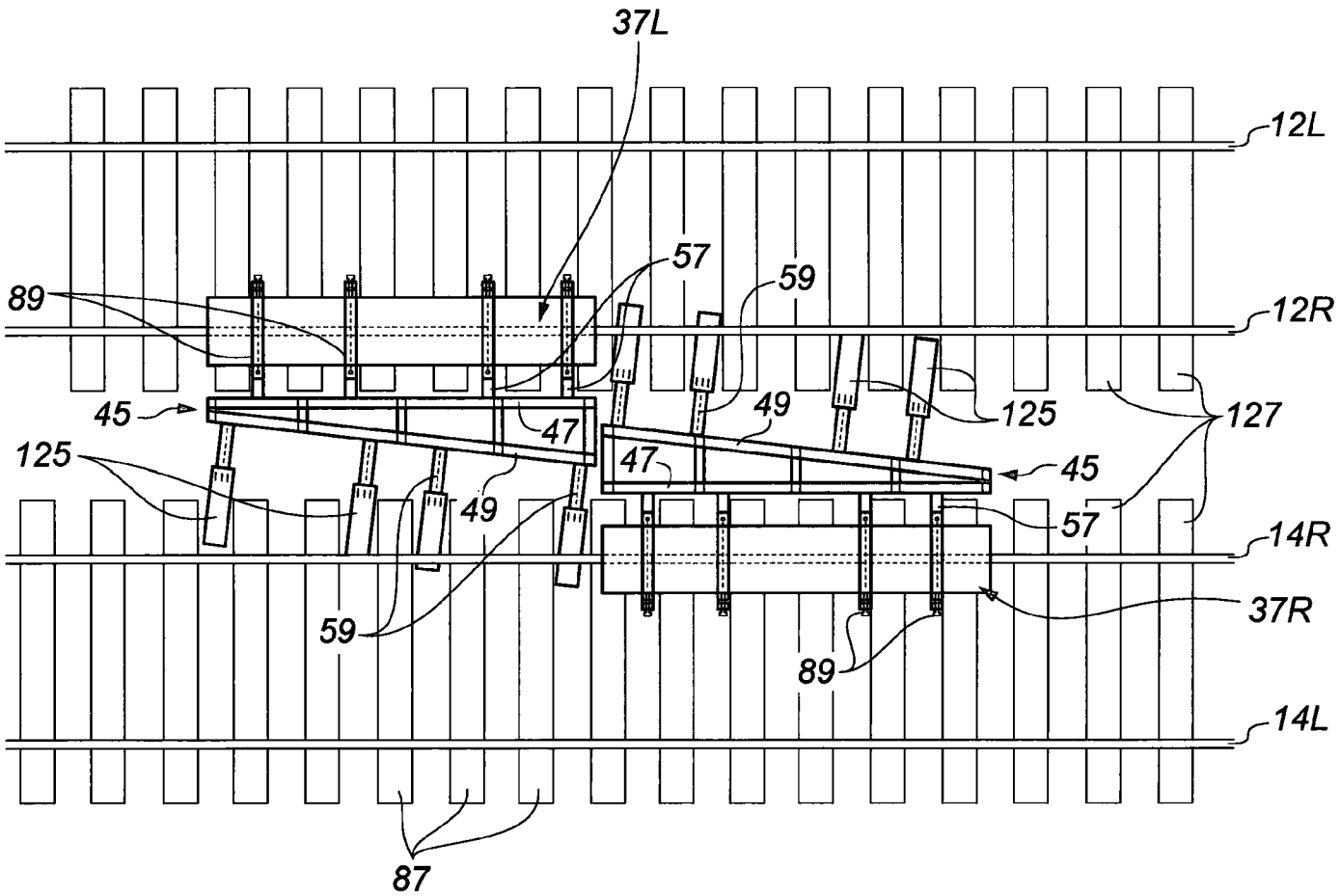
FIG. 13 is a plan view of a pair of A-frame gauge spacing guides in position prior to installation of the remaining crossover components of the track of FIG. 1.
Figure 14:
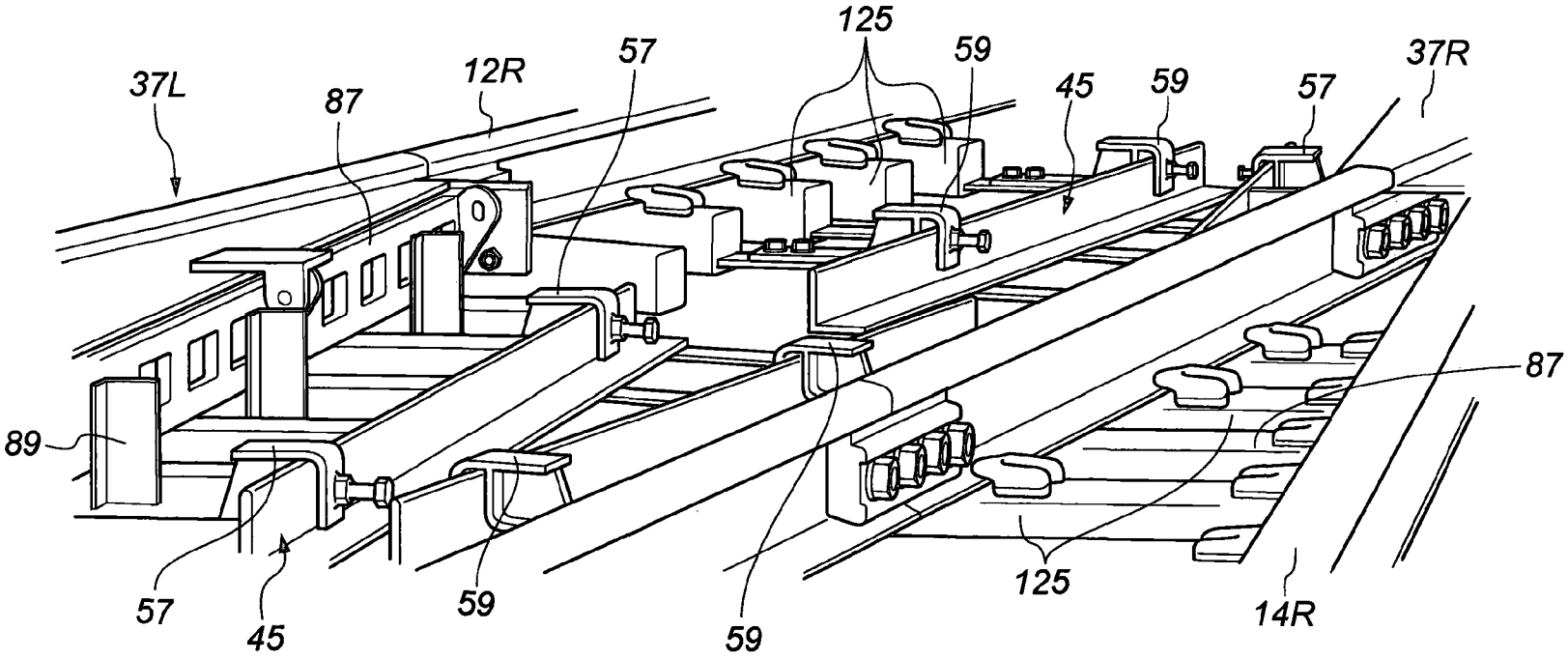
FIG. 14 is a perspective schematic illustration of a pair of A-frame gauge spacing apparatus in position with a crossover arrangement.
Figure 15:
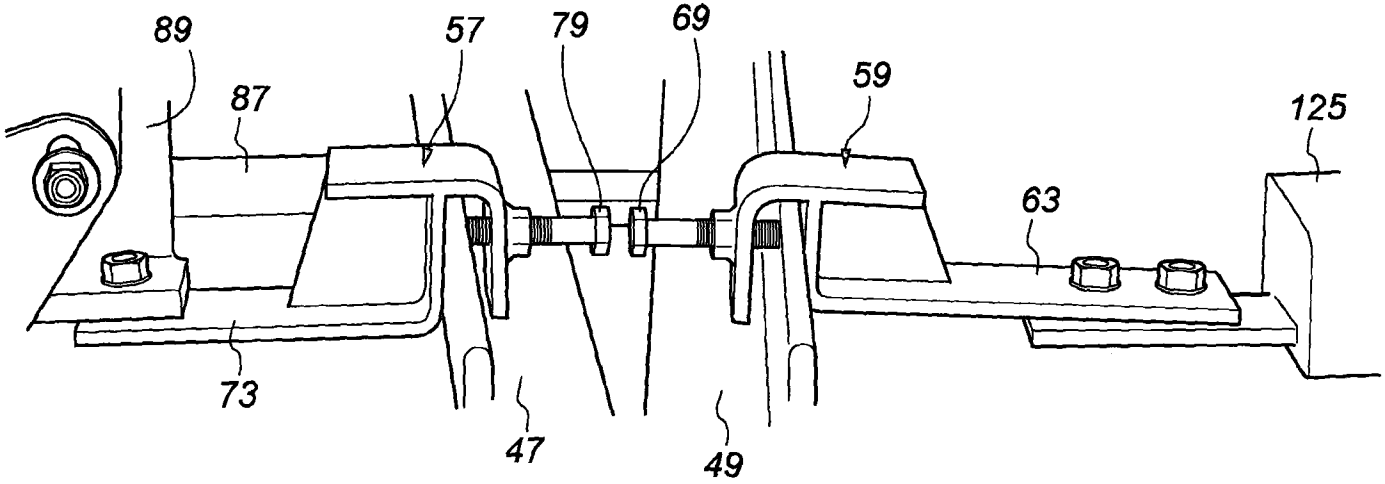
FIG. 15 is a perspective schematic illustration of a pair of adjustable sleeper engagement brackets secured to the A-frame of FIG. 10.
Figure 16:
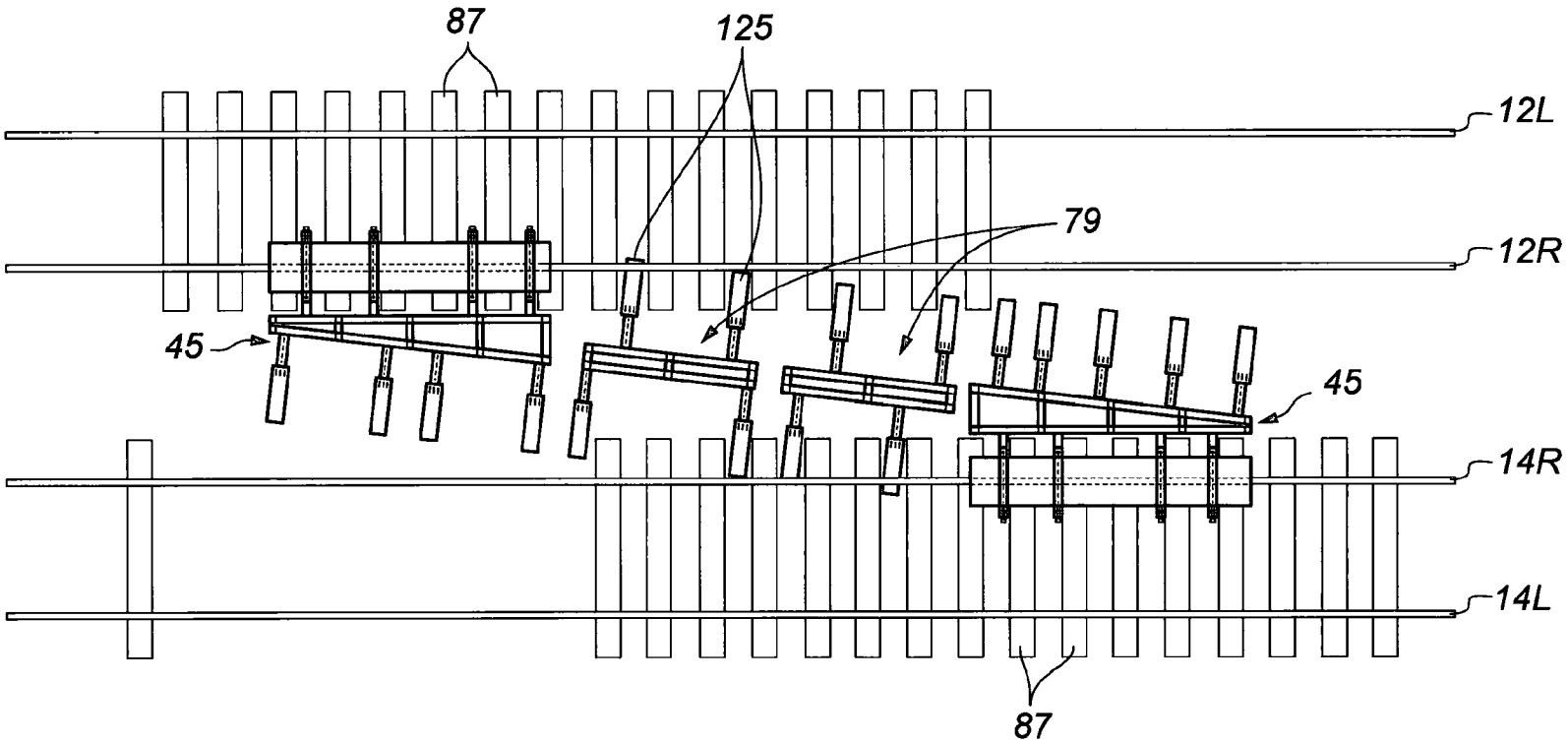
FIG. 16 is a plan view of a pair of A-frame gauge spacing guides and a pair of intermediate rectangular gauge spacing guides in position prior to installation of the remaining crossover components of the track.
Figure 17:
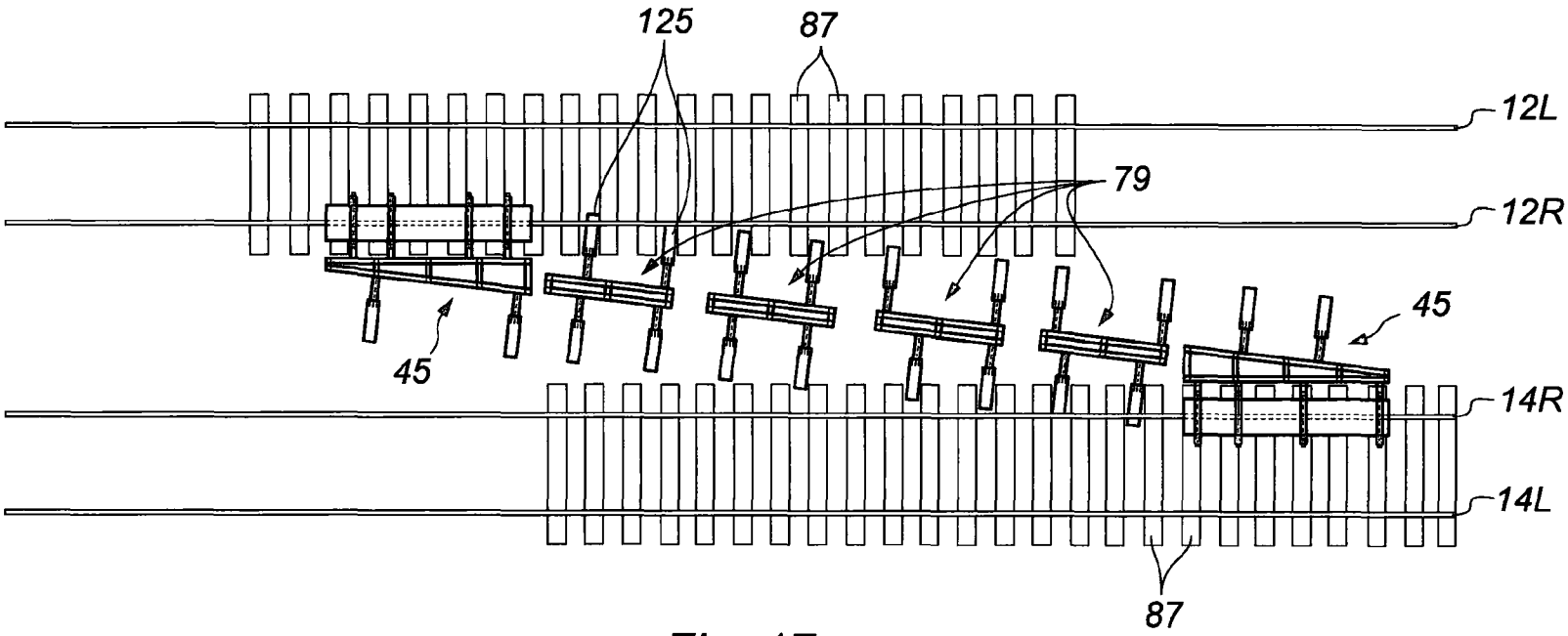
FIG. 17 is a plan a pair of A-frame gauge spacing guides and a plurality of intermediate rectangular gauge spacing guides in position prior to installation of the remaining crossover components of the track.
Figure 18:
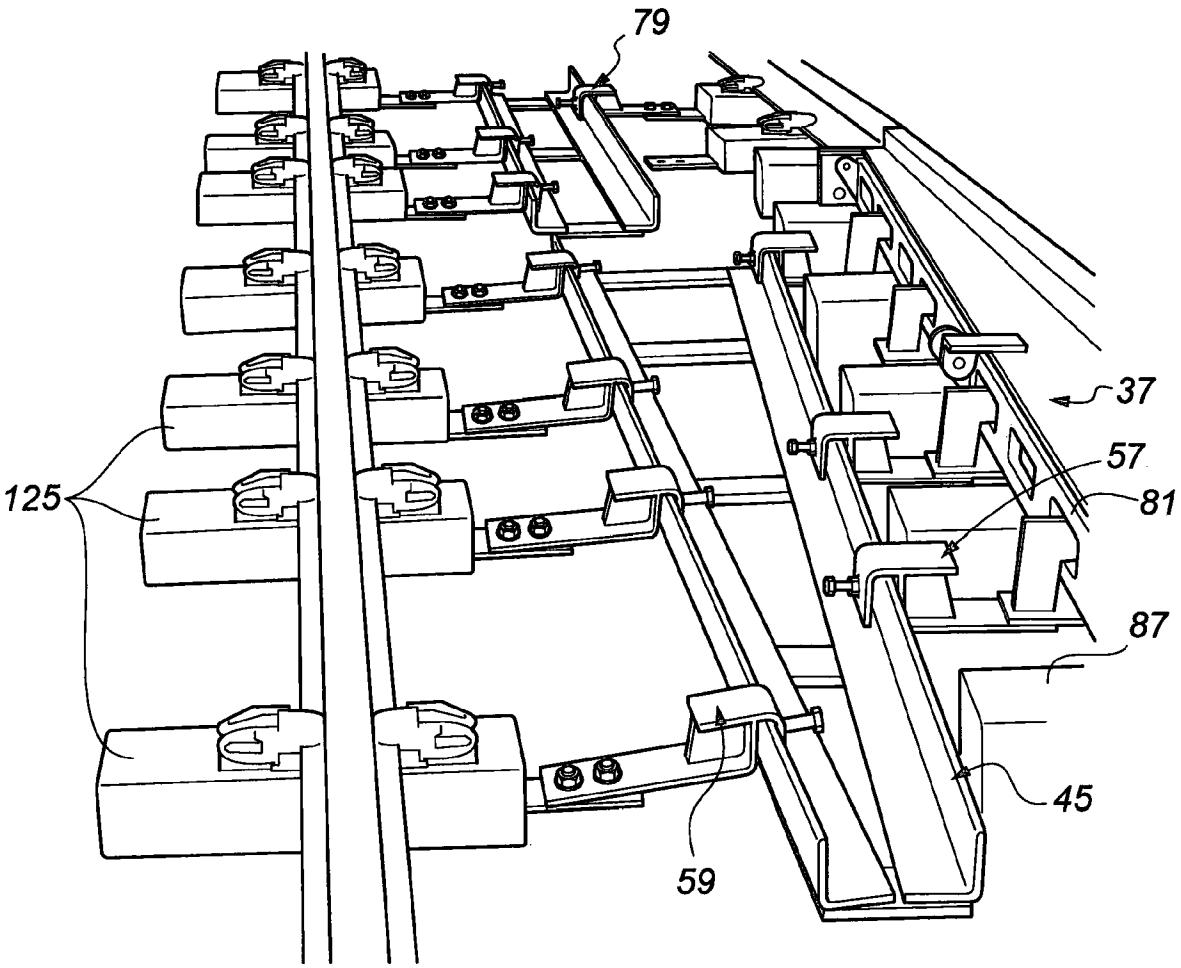
FIG. 18 is perspective schematic illustration of an A-frame gauge spacing guide and a rectangular-frame gauge spacing guide used in conjunction with one another on a section of railway where the first and second tracks are spaced apart from one another by a greater than typical distance.
Figure 19:
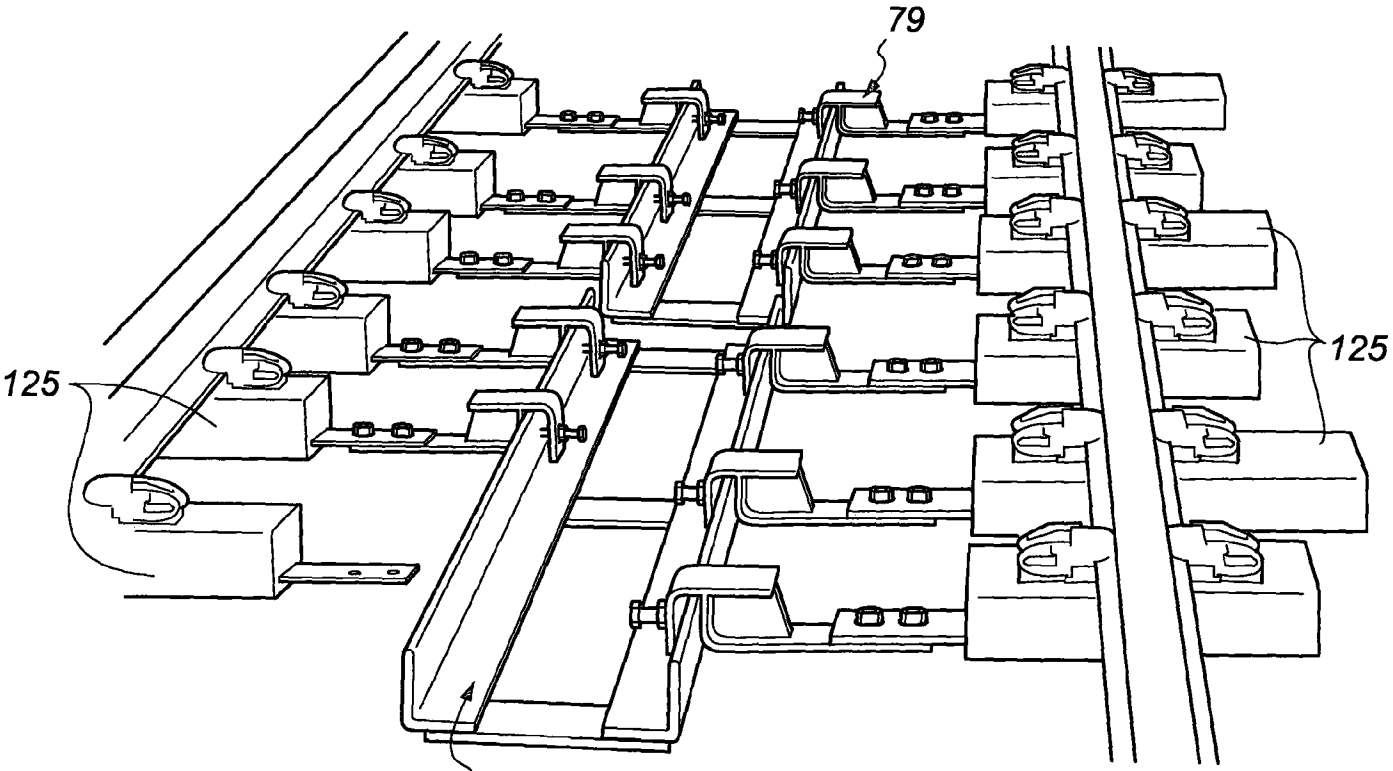
FIG. 19 is a perspective illustration of rectangular-frame gauge spacing guides in use with the crossover track installed.

When assembling the apparatus of the invention, in order to create a temporary crossover from one railway track to another, substantially similar steps as described in WO '179 are taken; however, when the step of spacing and positioning temporary pot sleepers 125 (which support the turnout rails 16, 18 during traversal from the southbound to the northbound rail) interstitially between the existing sleepers 127 is reached a pair of A-frames 45 are positioned between the tracks as illustrated in FIG. 13.

When positioning each A-frame 45, the parallel guide member 47 is placed adjacent the crossing arrangement 37 and is secured thereto by adjustment brackets 57. The adjustment brackets 57 are then secured at each end by tightening the bolt 79 around the upstanding flange of the parallel guide member 47 at one end and by bolting the lower flange 73 to the support clamp 89 of the crossing arrangement 37. This secures the A-frame relative to the existing track. Fine adjustments of the A-frame position may be made by loosening the bolts 79 of each adjustment bracket, sliding the guide member 47 therethrough and then tightening up the bolts 79 in order to secure the A-frame in its adjusted position.

The pot sleeper adjustment brackets 59 are then positioned in a similar way along the angled guide member 49. As illustrated in FIG. 13, the longitudinal position of the adjustment brackets 59 along the angled guide member 49 may be adjusted in order to mesh the pot sleeper 125 positions with the position of the existing sleepers 87. This arrangement not only allows the pot sleepers 125 to be interstitially arranged between the existing sleepers 87 without disturbing the existing sleepers 87 but also reliably maintains the gauge spacing between the left and right hand turnout rails in accordance with the angle and resultant constant spacing provided by the relative distance at any given point of the guide member 49 from the guide member 47. Once the pot sleepers and adjustment brackets 59 are positioned as desired, the adjustment brackets 59 are secured to the pot sleepers by securing connection bolts through the lower flange 63 of the brackets 59 and into the body of each respective pot sleeper there below.

In certain scenarios (for example when the second rail track to which the train is to be transferred is spaced further apart from the first section of rail track) it may be desirable to install one (or several) intermediate rectangular-frame arrangements 79 between the two A-frame arrangements 45. As illustrated in FIGS. 16 to 19, the number and length of rectangular frame arrangements 45 required will be dependent upon the distance between the two sections of railway track. In other words, where there is only a short additional spacing between the two railway tracks only a single rectangular frame may be required, whereas if there is a greater distance between the railway tracks then several consecutively positioned rectangular frames may be provided between the A-frame arrangements.

In common with the A-frame arrangements 45, the purpose of the rectangular-frame arrangements 79 is to allow interstitial positioning of the pot sleepers 125 between the existing sleepers 87 and to maintain the gauge spacing between the first and second turnout rails as they traverse from one track to another. Again in common with the A-frame arrangements 45, the adjustment brackets of the rectangular frames 79 may be moved along the guide members 81, 83 and then be secured in position once they coincide with gaps between the existing sleepers 87 on either side of the frame arrangements 79. In alternative embodiments, rather than many discrete rectangular frames 79, a single rectangular frame of the appropriate length required to span the distance between the two A-frame guides may be provided.

A further difference between the assembly method described in WO '179 and that of the present invention is the way in which the joint between the support box of crossover arrangements 37 and the turnout rails 16, 18 are arranged and this will now be described subsequently with particular reference to FIGS. 9A to 9D.

Once the support boxes 81 have been positioned underneath the components 27, 29, 31 of the switch rail arrangement 24, it is necessary to connect the end of each turnout rail thereto. This is achieved in the present invention by manoeuvring each rail 16, 18 on a crane, bogey or other lifting means such that its face plate 117 and upper shear plate 119 mate with the face plate 105 and lower shear plate 109 thereby also bringing the support ledges 121 and 109 of the respective shear plates into engagement with one another. Retaining bolts (not shown) are then inserted through aligned bolt holes provided in the respective face plates in order to retain the shear plates in engagement with one another.

The reader will appreciate that in alternative embodiments, the upper and lower shear plates could be arranged in the opposite sense i.e. the lower support plate could be provided on the facing plate 117 and the upper support plate could be provided on the facing plate 105.

The described shear plate arrangement allows a quick and reliable joint to be created between the turnout rails and support boxes of the switch rails 24. Furthermore, removal of the joint can also be performed quickly and easily by simply removing the attachment bolts and lifting the turnout rails 16, 18 away from the support boxes.

The steps involved in putting a temporary non-intrusive crossover system having the features of the present invention in place on an existing section of track will now be described. Subsequent to that, the steps involved in removing the temporary crossover system from the existing section of track will then be described. It should be noted that throughout the installation and removal steps subsequently described no damage is caused to the existing track.

In the following description, the steps will be described from left to right as viewed in FIG. 1; however, the sequence of these steps is not intended to be limiting and indeed it is likely that many of these steps be performed simultaneously where an operator or team of operators work on one section of crossover whilst another operator or team of operators work on another section of the crossover.

Support boxes 81 and their associated support timbers 85A, 85B are installed on left and right sections of the track 12L, 12R at the location in which the ramp sections 22L, 22R are desired. The ramp sections 22L, 22R are then placed into position on top of the support boxes and support timbers and are secured in place thereto. Hinged brackets 21 are also engaged with associated hinges on the support boxes in order to allow the installed ramp sections to be hinged into and out of position on the track.

Three support boxes 81 and their associated support timbers are installed on left and right sections of the track 12L, 12R adjacent the ramps 22L, 22R in preparation for installation of the switch rails 24L, 24R. The three switch rail sections 27, 29, 31 are then placed into position on top of their respective support boxes and timbers and then secured in place thereto. Hinged brackets 26 are also engaged with associated hinges on the support boxes in order to allow the installed switch rail sections to be hinged into and out of position on the track.

Several temporary pot sleepers 125 connected to one another by couplings 127 are then positioned in the desired position coinciding with the desired eventual position of the turnout rails 16, 18.

The turnout rails 16, 18 are then brought into position over the pot sleepers 125 and joined with the support box 81 of switch rail arrangement 31 in the method previously described. The rails 16, 18 are then secured to the pot sleepers 125 in the normal way with e.g. "pandrol" clips.

Support boxes and their associated support timbers are installed on the rails 12R, 14R at the location in which the crossover arrangements 37L, 37R are desired.

The A-frames 45 are then attached to the support boxes of the crossover arrangements 37L, 37R and the respective pot sleepers 125 positioned interstitially between the existing sleepers 87 as previously described. The crossover arrangements 37L, 37R are then placed into position on top of the support boxes and support timbers and secured in place thereto. Hinged brackets 32 are also engaged with associated hinges on the support boxes in order to allow the installed crossover sections to be hinged into and out of position on the track. Intermediate sections of turnout rail are then secured to the pot sleepers attached to the A-frames 45.

The remainder of the installation downstream of the crossover sections 37L, 37R replicates that which has already been described upstream of the crossover sections 37L, 37R and will not therefore be described further.

In operation, when a train travels along the southbound track 12 it first mounts the ramp rails 22L, 22R which raise the wheels of the train by an amount (typically 50 mm) which is sufficient to allow the flanged part of the wheel to reside vertically above the height of the rest of the normal track 12L, 12R. Thus, when the train moves onto the switching arrangements 24L, 24R, and crossing arrangements 37L, 37R the left hand 16 and right hand 18 turnout tracks are of a sufficient height such that the flanged part of the wheels, which normally act to keep the train on the tracks, are able to clear the rail tracks 12R, 14R. This raised height is maintained until the train reaches the second set of ramp rails (not shown) at the other end of the non-intrusive crossover section 10 at which point it will then be lowered by the second set of ramps 24 and carry onward along the north bound rail track 14 in the south bound direction (until being transferred back on to the southbound track 12 by a second crossover system once past the section of track requiring maintenance or repair).

Those skilled in the art will appreciate that, if a train requires to pass through the non-intrusive temporary turnout 10 without actually crossing over from one track 12 onto another track 14, the ramp rail arrangements 22, switch rail arrangements 24 and crossover arrangements 37 can be removed or hinged out of their active position such the train will be able to bypass the non-intrusive temporary turnout 10. Indeed, it will be appreciated by the reader that, in this embodiment, many components of the apparatus may be left in position during normal running of the railway track. These include for example, the support boxes 81, the pot sleepers 125 and the frames 45, 79.

If there is no longer likely to be any need for the non-intrusive crossover section 10 at a particular section of railway track in the near future then the support boxes 81, the pot sleepers 125, the frames 45, 79 and the temporary raised turnout rails 16, 18 can be permanently removed for future use elsewhere. During such disassembly of the system, removal of the joint between the turnout rails 16, 18 and the support boxes of the switch rail section 31 is achieved quickly and reliably by removing any attachment bolts provided through the face plates 105, 117 and simply lifting the shear plates out of engagement with one another.

Modifications and improvements may be made to the embodiments described herein without departing from the scope of the invention.

The invention claimed is:

1. Gauge spacing apparatus for positioning a plurality of pot turnout sleepers with respect to existing sleepers of an existing railway track provided with a pair of turnout rails which are separated from one another by a desired gauge distance, the gauge spacing apparatus comprising:

a first guide member substantially aligned with and secured with respect to a portion of existing rail; and a second guide member which is angled with respect to the first guide member;

wherein at least one of the first and second guide members is provided with at least an adjustable sleeper engagement bracket adapted in use to selectively translate along at least a portion of the respective first or second guide members and to connect to a respective existing sleeper of the existing railway track or to a pot turnout sleeper of the turnout rails; and wherein the first guide member extends in a first longitudinal direction and the second guide member extends in a second longitudinal direction, and wherein the adjustable sleeper engagement bracket is adapted in use to selectively translate in the respective first or second longitudinal directions.

2. Apparatus according to claim 1, wherein the or each adjustable sleeper engagement bracket comprises a clamping portion actuable between a released configuration, in which a longitudinal position of the or each adjustable sleeper engagement bracket may be adjusted along the length of its respective guide member, and a secured configuration, in which the longitudinal position of the or each adjustable sleeper engagement bracket is fixed.

3. Apparatus according to claim 2, wherein the or each adjustable sleeper engagement bracket further comprises a sleeper attachment portion which in use allows the or each adjustable sleeper engagement bracket to be secured with respect to an associated existing sleeper or pot turnout sleeper.

4. Apparatus according to claim 3, further comprising a plurality of pot turnout sleepers mounted to the adjustable sleeper engagement bracket of the second guide member.

5. A method of supporting and maintaining gauge spacing in a pair of turnout rails of an existing railway track, the method comprising:

positioning a first guide member with respect to a portion of existing rail of the existing railway track;

positioning a second guide member with respect to a turnout rail;

positioning a plurality of pot turnout sleepers interstitially between existing rails of a second railway track and beneath at least one of the turnout rails;

attaching a plurality of adjustable sleeper engagement brackets to the first guide member, adjusting these into position adjacent respective existing sleepers of the existing railway track and securing these in position with respect to the existing sleepers and to the first guide member; and attaching a plurality of adjustable sleeper engagement brackets to the second guide member, adjusting these into position over the respective pot turnout sleepers and securing these in position to the pot turnout sleepers and to the second guide member such that a desired gauge distance between the turnout rails is maintained.

6. A method according to claim 5, wherein the step of adjusting the position of the sleeper engagement brackets comprises loosening a clamping part thereof, longitudinally reciprocating the sleeper engagement brackets along their respective guide members until they are in the desired position and then tightening said clamping part in order to retain the sleeper engagement brackets relative to the first and second guide members.

7. A method according to claim 5, further comprising supporting and maintaining gauge spacing in the pair of turnout rails by way of a gauge spacing apparatus.

8. Gauge spacing apparatus for positioning pot turnout sleepers for turnout rails having a desired gauge distance and which are provided between a pair of railway tracks which are separated from one another by a rail spacing distance, the gauge spacing apparatus comprising:

a first guide member adapted to be substantially aligned with and secured to pot turnout sleepers of a first turnout rail; and a second guide member adapted to be substantially aligned with and secured to pot turnout sleepers of a second adjacent turnout rail and at least a spacing member between the first and second guide members such that said desired gauge distance between the turnout rails is maintained and wherein at least one of the first and second guide members is provided with adjustable sleeper engagement brackets which are adapted to selectively translate along at least a portion of the first or second guide members which in use allow the sleeper engagement brackets of the first guide member to be secured to pot turnout sleepers which are interstitially positioned between existing sleepers of a first railway track in the pair of railway tracks and for the sleeper engagement brackets of the second guide member to be secured to pot turnout sleepers which are interstitially positioned between existing sleepers of a second railway track in the pair of railway tracks.

9. Apparatus according to claim 8, wherein the adjustable sleeper engagement brackets comprise a clamping portion actuable between a released configuration, in which a longitudinal position of the adjustable sleeper engagement bracket may be adjusted along the length of its respective guide member, and a secured configuration, in which the longitudinal position of the adjustable sleeper engagement bracket is fixed.

10. Apparatus according to claim 9, wherein the adjustable sleeper engagement brackets further comprise a pot turnout sleeper attachment plate which allows the adjustable sleeper engagement bracket to be secured to an associated pot turnout sleeper provided thereunder.

11. Apparatus according to claim 10, further comprising a plurality of pot turnout sleepers mounted to the adjustable sleeper engagement brackets of the first and second guide members.

12. A method of supporting and maintaining gauge spacing in a pair of turnout rails provided with the apparatus of claim 1, the method comprising:

positioning the first guide member with respect to a first rail of the turnout rails;

positioning the second guide member with respect to a second rail of the turnout rails;

positioning a plurality of pot turnout sleepers interstitially between existing rails of a first section of the existing railway track and beneath the first turnout rail;

positioning a plurality of pot turnout sleepers interstitially between existing rails of a second section of the existing railway track and beneath the second turnout rail;

attaching a plurality of adjustable sleeper engagement brackets to the first guide member, adjusting these into position over respective pot turnout sleepers thereunder and securing these in position to said pot turnout sleepers and to the first guide member; and attaching a plurality of adjustable sleeper engagement brackets to the second guide member, adjusting these into position over the respective pot turnout sleepers thereunder and securing these in position to said pot turnout sleepers and to the second guide member such that said desired gauge distance between the turnout rails is maintained.

13. A method according to claim 12, wherein the step of adjusting the position of the sleeper engagement brackets comprises loosening a clamping part thereof, longitudinally reciprocating the sleeper engagement brackets along their respective guide members until they are in the desired position and then tightening said clamping part in order to retain the sleeper engagement brackets relative to the first and second guide members.

* * * * *